US011353280B1

(12) United States Patent
Keeney et al.

(10) Patent No.: US 11,353,280 B1
(45) Date of Patent: Jun. 7, 2022

(54) BOW STABILIZERS

(71) Applicant: Bear Archery, Inc., Evansville, IN (US)

(72) Inventors: Sean Keeney, Henderson, KY (US); David Alsip, Evansville, IN (US); James Mogle, Evansville, IN (US)

(73) Assignee: BEAR ARCHERY, INC., Evansville, IN (US)

( * ) Notice: Subject to any disclaimer, the term of this patent is extended or adjusted under 35 U.S.C. 154(b) by 0 days.

(21) Appl. No.: 17/304,189

(22) Filed: Jun. 16, 2021

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/14; F41B 5/1426
USPC ..... 124/89
See application file for complete search history.

(56) References Cited

U.S. PATENT DOCUMENTS 3,412,725 A * 11/1968 Hoyt, Jr. ..... F41B 5/1426 124/84
3,683,883 A * 8/1972 Izuta ..... F41B 5/1426 267/136
4,245,612 A * 1/1981 Finlay ..... F41B 5/1426 124/89
4,570,608 A * 2/1986 Masterfield ..... F41B 5/1426 188/378
4,615,327 A * 10/1986 Saunders ..... F41B 5/1426 124/89
4,660,538 A * 4/1987 Burgard ..... F41B 5/1426 124/88
4,779,602 A * 10/1988 Hess, Sr. ..... F41B 5/1426 267/136
4,936,283 A * 6/1990 Izuta ..... F41B 5/1426 124/89
4,982,719 A * 1/1991 Haggard ..... F41B 5/1426 124/23.1
5,016,602 A * 5/1991 Mizek ..... F41B 5/1426 188/378
5,273,022 A * 12/1993 Leven ..... F41B 5/1426 124/88
5,370,104 A * 12/1994 Neie ..... F41B 5/1426 267/177
5,385,136 A * 1/1995 Thomas ..... F41B 5/1426 188/378
5,390,656 A * 2/1995 Villa ..... F41B 5/1426 188/379

(Continued)

*Primary Examiner* — Alexander R Niconovich
(74) *Attorney, Agent, or Firm* — Woodard, Emhardt, Henry, Reeves & Wagner, LLP

(57) ABSTRACT

Aspects of the present disclosure deal with bow stabilizers mounted or mountable on an archery bow. The stabilizer incorporates a hollow housing with a proximal end and a distal end. Mounted to the distal end of the housing is a coupling formed of elastic vibration damping material. The coupling includes an outer wall section extending within the housing and a cylinder spaced inward from the outer wall section. Extending between the outer wall section and the cylinder are one or more flexible connectors. The cylinder supports a shaft with an inner weight mounted to a first end and spaced inward from the housing. The shaft and inner weight are arranged in a floating arrangement where oscillation of the shaft and inner weight does not impact the housing.

16 Claims, 8 Drawing Sheets

(56) References Cited

U.S. PATENT DOCUMENTS 5,460,156 A * 10/1995 Sappington ..... F41B 5/1426 188/380
5,471,969 A * 12/1995 McDonald, Jr. ..... F41B 5/1426 124/89
5,617,664 A * 4/1997 Troncoso ..... F41B 5/1426 42/1.06
5,735,257 A * 4/1998 Walk ..... F41B 5/1426 188/378
5,904,134 A * 5/1999 Denbow ..... F41B 5/1426 124/89
5,975,070 A * 11/1999 Sands ..... F41B 5/1426 267/136
6,186,135 B1 * 2/2001 Harwath ..... F41B 5/1426 124/89
6,588,414 B2 * 7/2003 McMillan, III ..... F41B 5/1426 124/88
6,817,352 B1 * 11/2004 Saunders ..... F41B 5/1426 267/136
8,590,522 B2 * 11/2013 Khoshnood ..... F41B 5/1426 124/88
8,833,356 B2 * 9/2014 Khoshnood ..... F41B 5/1426 124/88
8,893,700 B2 * 11/2014 Kozlik ..... F41B 5/1426 124/88
9,016,268 B2 * 4/2015 Leven ..... F41B 5/1426 124/89
9,038,618 B1 * 5/2015 Bomar ..... F41B 5/1426 124/88
9,733,040 B2 * 8/2017 Roady ..... F41B 5/14
9,909,833 B1 * 3/2018 Huang ..... F41B 5/1426
10,132,590 B2 * 11/2018 Leven ..... F41B 5/1426
10,436,543 B2 * 10/2019 Wilkens ..... F41B 5/1426
10,605,559 B2 * 3/2020 Summers ..... F41B 5/1426
10,619,967 B2 * 4/2020 Kelly ..... F41B 5/1426
10,648,762 B2 * 5/2020 Jonas, IV ..... F41B 5/1426
10,704,858 B1 * 7/2020 Mason ..... F41B 5/1426
10,753,701 B2 * 8/2020 Jonas, IV ..... F41B 5/1426
2010/0192932 A1 * 8/2010 Brewster ..... F41B 5/1426 124/89
2010/0319669 A1 * 12/2010 Grace, Jr. ..... F41B 5/1426 124/92
2012/0240913 A1 * 9/2012 Stokes ..... F41B 5/1426 124/89
2013/0055998 A1 * 3/2013 LoRocco ..... F41B 5/1426 29/428
2017/0089661 A1 * 3/2017 Potts ..... F41G 1/467

* cited by examiner

BOW STABILIZERS

FIELD OF THE DISCLOSURE

Aspects of the present invention deal with archery bows, and in particular deal with accessories such as stabilizers usable with archery bows.

BACKGROUND

A bow stabilizer may be used to assist an archer in aiming an archery bow. A typical bow stabilizer includes a stabilizer body connected to a riser of the bow with one or more threaded fasteners. The stabilizer is often made from a single unitary component and/or from a combination of components. Typically, stabilizers include a vibration reducing material such as rubber. In other examples, stabilizers are made from lightweight materials such as carbon fiber. In many stabilizers, one or more weights may be added to the distal end of the stabilizer in order to assist an archer in balancing a bow.

Typical bow stabilizers reduce vibration by absorbing the vibration within the vibration reducing material. In other examples, the vibration is reduced due to the added weight at the end of the stabilizer to dampen the bow's vibrations. Excessive vibration and/or the effects of vibration over time may lead to wear and tear on the bow. As should be appreciated, mitigating the amount of wear and tear on the bow is desirable to an archer. As a result, vibration transfer from the stabilizer into the bow is undesirable to an archer. Stabilizers also decrease the amount of recoil or "hand shock" felt by an archer after a shot. As should be appreciated, reducing the recoil of the shot enables an archer to shoot for longer periods and with a greater amount of comfort and accuracy.

Stabilizers are also used by archers to increase stability of the bow when at full draw. For example, a forwardly weighted stabilizer will act as a counterbalance to the bow at full draw lessening pin movement and increasing accuracy.

SUMMARY

Certain embodiments provide a stabilizer for an archery bow which incorporates a floating weight assembly. The stabilizer includes a hollow housing having a length defining a rear or proximal end and a forward or distal end, wherein the proximal end is configured to secure the housing to an archery bow. A damping coupling formed of an elastic vibration damping material is mounted to the distal end of the housing. The damping coupling includes an outer wall section partially extending into the length of the housing from the distal end and a cylinder spaced inward from the outer wall section. A plurality of flexible connectors radially connect and space the cylinder relative to the outer wall section. A shaft extends through the cylinder. The shaft has a length defining a first end located within the housing and a second end extending outward from the housing. An inner weight is mounted to the first end of the shaft and spaced inward from the housing. At least one outer weight is mounted to the second end of the shaft. The shaft and inner weight are arranged in a floating arrangement via the damping coupling with respect to the housing. For instance, the shaft and inner weight are arranged to oscillate within the damping coupling without impacting the housing when vibrations are transferred to the stabilizer.

Other objects and attendant advantages will be readily appreciated, as the same become better understood by reference to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the disclosure relates.

Figure 1:
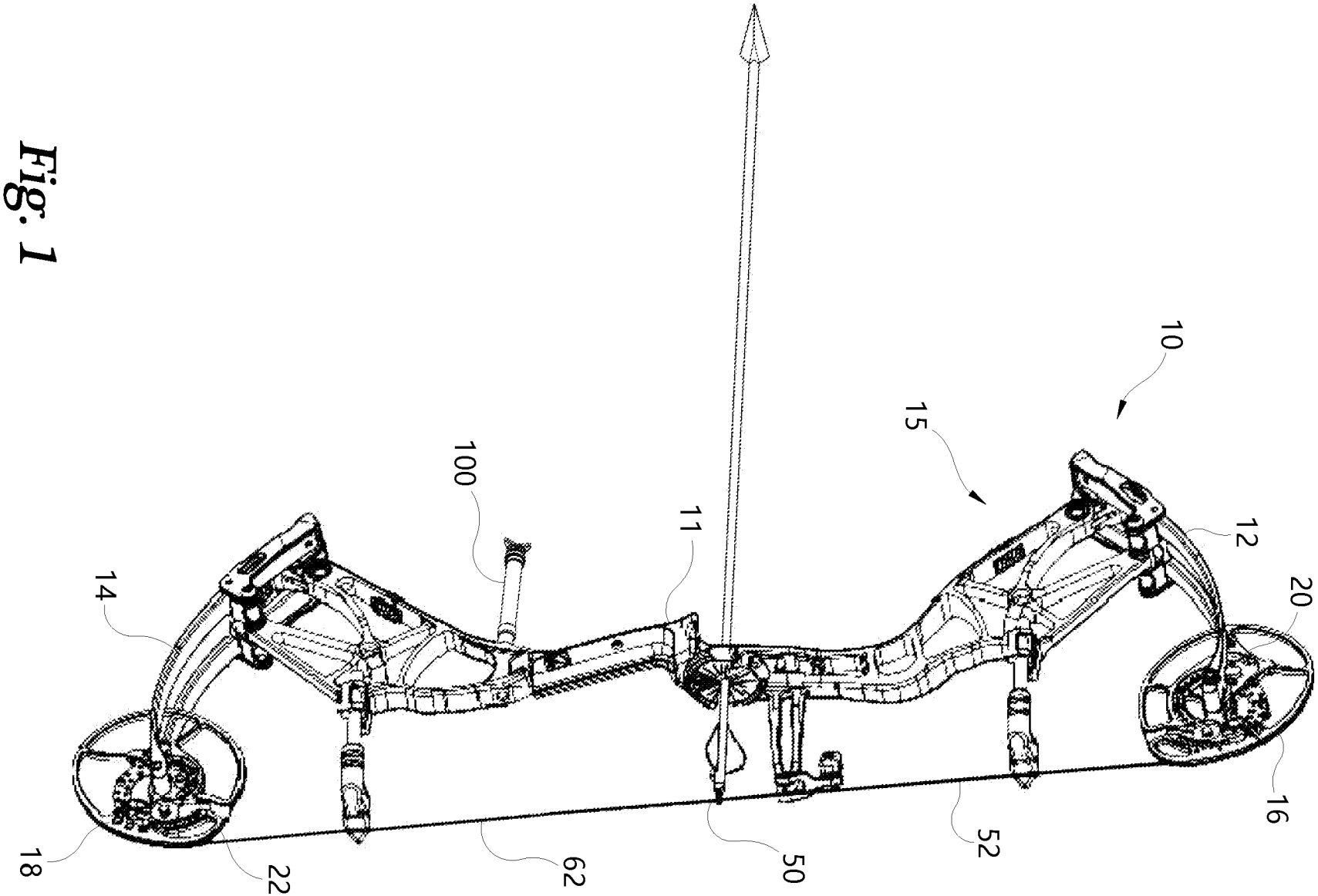
FIG. 1 is a perspective view of a representative embodiment of an archery bow with a bow stabilizer according to an embodiment of the present disclosure.

FIG. 1 illustrates a representative example of an archery bow 10 incorporating a stabilizer 100 according to the present disclosure. Bow 10 includes a riser 11 with a handle, an upper limb or pair of limbs 12 and a lower limb or pair of limbs 14. In the embodiment shown, upper and lower limbs are formed of parallel and symmetric limbs sometimes called a quad limb arrangement. Alternately, a single piece limb can have a notch or slot area removed to allow a rotational element to be mounted to the limb tips. In the single cam example, illustrated, rotational members such as idler wheel 16 and eccentric cam 18 are supported at the limb tip sections for rotary movement about axles 20 and 22. An upper pulley axle 20 is carried between the outer limb tip portions of upper limb 12. A lower pulley axle 22 is carried between the outer limb tip portions of lower limb 14.

The portion of the cable, which defines the bowstring 50, includes an upper portion 52 and a lower portion 62 which are fed-out from idler wheel 16 and cam 18 when the bow is drawn. The upper portion 52 may be part of a longer cable which has a medial portion mounted around idler wheel 16 with the ends mounted to cam 18. The non-bowstring portion of the cable extending from wheel 16 to cam 18 can be referred to as the return cable portion. Additionally, a y-yoke anchor cable (not shown for ease of illustration) has a lower end mounted to cam 18, which extends to two upper ends mounted adjacent opposing ends of axle 20. Each cable has a thickness and a round cross-section defining a circumference. From the perspective of the archer, the bowstring is considered rearward relative to the riser, which defines forward.

When the bowstring 50 is drawn, it causes idler wheel 16 and cam 18 at each end of the bow to rotate, feeding out cable and bending limbs 12 and 14 inward, causing energy to be stored therein. When the bowstring 50 is released with an arrow engaged to the bowstring, the limbs 12 and 14 return to their rest position, causing idler wheel 16 and cam 18 to rotate in the opposite direction, to take up the bowstring 50 and launch the arrow with an amount of energy proportional to the energy initially stored in the bow limbs. Bow 10 is described for illustration and context and is not intended to be limiting.

While not illustrated, embodiments of the present disclosure can also be used in other types of bows, for example, dual cam or two cam bows, hybrid cam bows or recurve bows, which are considered conventional for purposes of the present disclosure. For convenience, the combination of riser 11 and either single or quad limbs forming upper limb 12 and lower limb 14 may generally be referred to as archery bow body 15. Accordingly, it should be appreciated that the archery bow body can take on various designs in accordance with the many different types of bows with which the present disclosure can be used.

Various accessories, such as arrow rests, bow sights, and quivers can be mounted to bow body 15. Commonly, bow sights are used in combination with a peep sight. Bow sights are typically mounted to or formed as part of riser 11 above the arrow rest position. Generally, the sight defines at least one aiming point.

Figure 2:
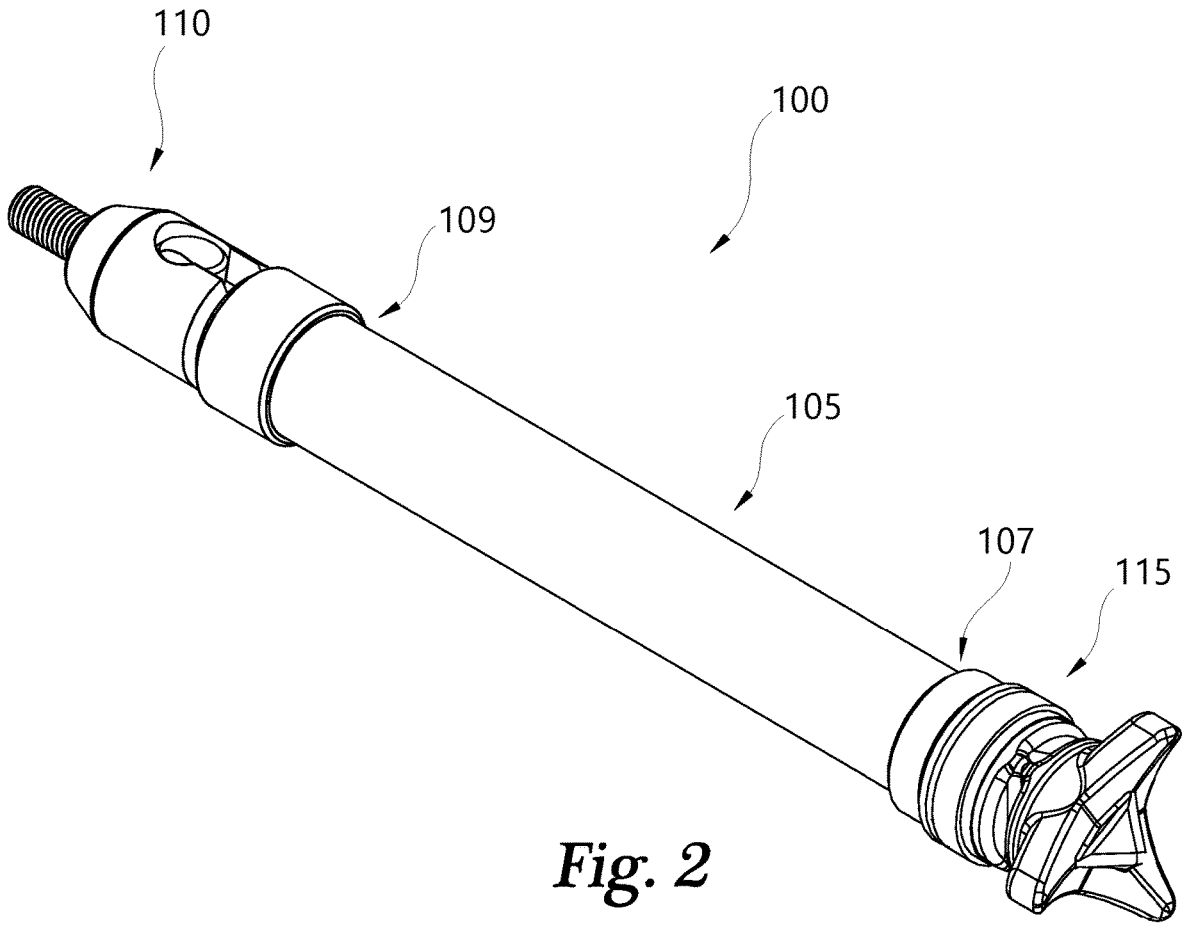
FIG. 2 is a perspective view of a bow stabilizer according to an embodiment of the present disclosure.
Figure 3:
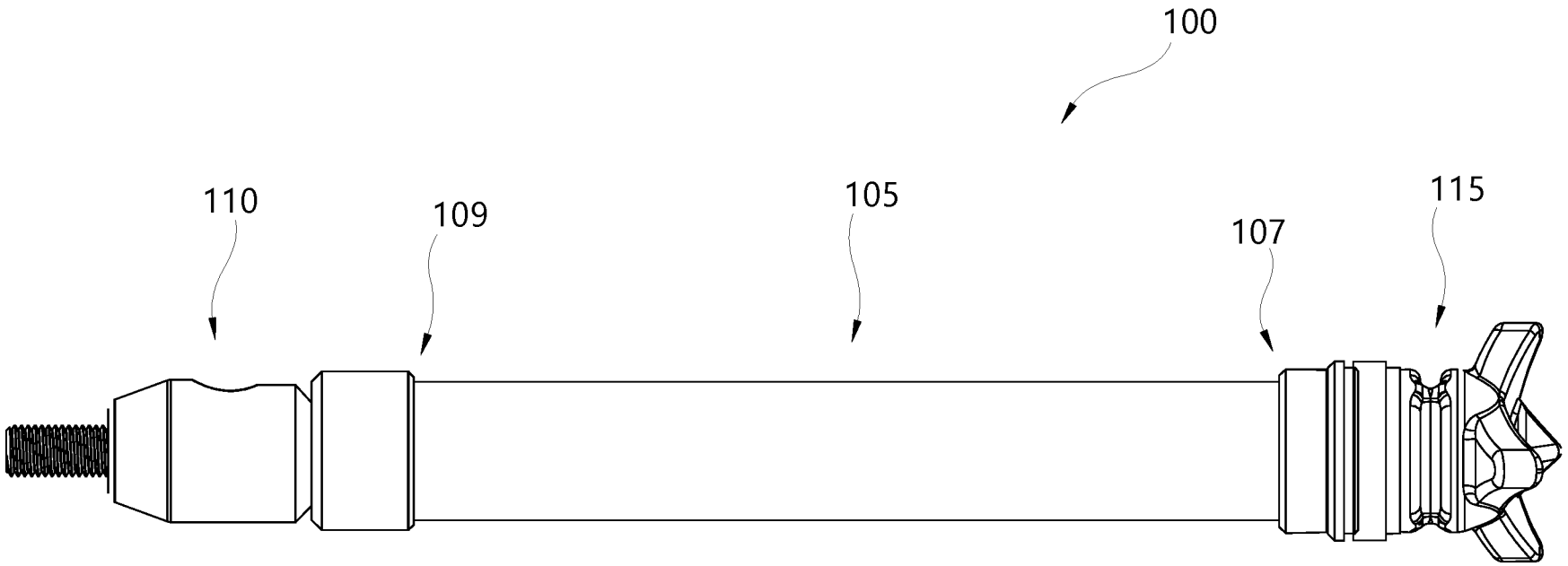
FIG. 3 is a side view of the bow stabilizer of FIG. 2.

FIGS. 2 and 3 illustrate an example of a stabilizer 100 according to a representative embodiment of the present disclosure. The stabilizer 100 generally includes a body 105, a mounting assembly 110, and a damping assembly 115. As illustrated in FIG. 1, typically, the stabilizer 100 is mounted to an archery bow to assist in reducing bow vibration following a shot. The stabilizer 100 is also used to provide a counterbalancing weight to the bow to assist in stabilization of the bow at full draw.

The stabilizer body 105 may include a rearward or proximal end 109, which is typically nearer the bow, and a forward or distal end 107, which is typically further from the bow. The body 105 is generally formed from a lightweight material. For example, the stabilizer body 105 may be made from carbon fiber, plastic or similar materials. A carbon fiber material provides a lightweight stabilizer, thus reducing overall weight of the stabilizer. In another example, the body 105 may be made from rubber. As should be appreciated, a rubber stabilizer will absorb/dampen vibration more efficiently after a shot, but would add weight compared to carbon fiber.

The mounting assembly 110 is generally mounted to the proximal end 109 of the stabilizer body 105. The mounting assembly enables an archer to mount and remove the stabilizer from the bow. As discussed in detail hereafter, the stabilizer may be mounted to the riser of the bow directly via a threaded fastener. In another example, the stabilizer may be mounted to the riser of the bow indirectly via a quick disconnect mechanism. The quick disconnect enables an archer to remove the stabilizer from the bow without needing to unscrew the mounting assembly 110 from the riser.

The damping assembly 115 is generally mounted to the distal end 107 of the stabilizer body 105. The damping assembly 115 dampens the vibrations from the bow following a shot, while minimizing vibration transfer back into the bow. As should be appreciated, the damping assembly 115 also assists in noise reduction of the bow after a shot. In some examples, the damping assembly 115 may include one or more weights configured to counterbalance the bow at full-draw. The counterbalancing force of the weights assist an archer in stabilizing the bow during the shot.

Figure 4:
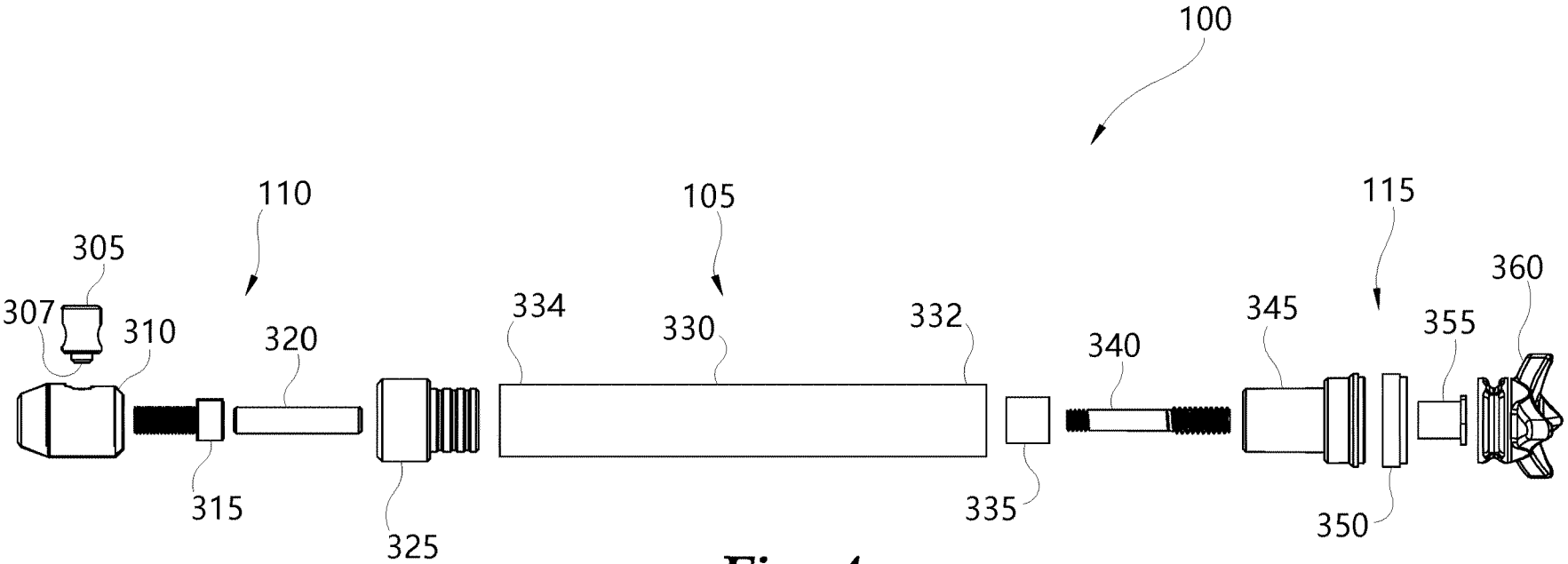
FIG. 4 is an exploded view of the bow stabilizer FIG. 2.
Figure 5:
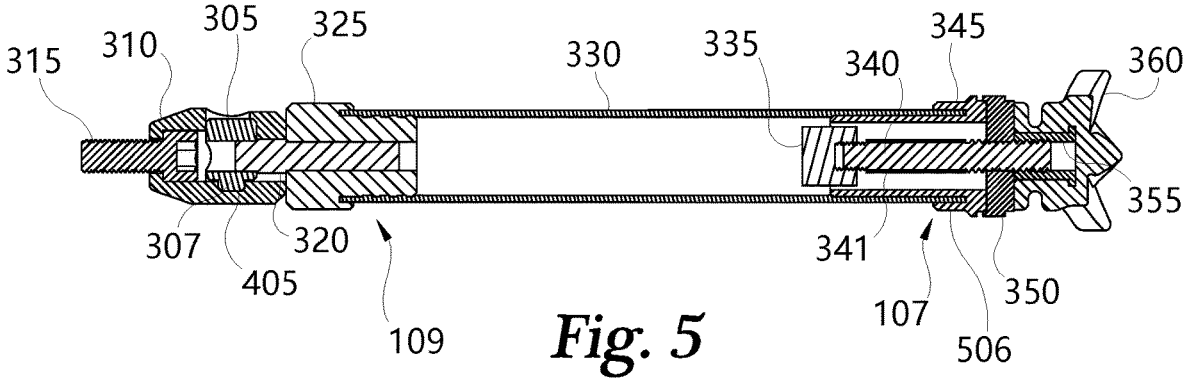
FIG. 5 is a cross-sectional view of the bow stabilizer of FIG. 2.

FIG. 4 illustrates an exploded view of the stabilizer 100 showing individual components of the body 105, mounting assembly 110, and damping assembly 115. FIG. 5 illustrates a cross-sectional view of the assembled stabilizer 100. The body 105 generally includes a housing 330 having a distal end 332 and a proximal end 334 defining a length. In one form, the housing 330 is a hollow rod or cylinder formed from a carbon or plastic material. In another form, the housing 330 is formed from a rubber material with a hollow interior. In yet another form, the housing 330 is a hollow carbon rod filled with a vibration dampening material.

The damping assembly 115 includes a damping coupling 345. The coupling 345 connects the damping assembly 115 to the housing 330. Typically, the coupling 345 connects to the housing 330 at the distal end 332 of the housing. The coupling 345 is generally made from an elastic vibration damping material, such as rubber. The coupling 345 includes an outer wall section 520. The outer wall section 520 includes an inner portion extending at least partially into the length of the housing 330 from the distal end 332. The inner portion extends adjacent an inner wall of the housing for a certain distance. The outer wall section 520 may extend out of and around the distal housing end 332 forming a circumferential ring or groove 505 that receives the distal housing end 332. The groove 505 retains the housing 330 via a friction fit by sandwiching the housing between the outer wall section 520 and a lip 506. Alternately, adhesive or a mechanical fastener may be used to secure damping coupling 345 to housing 330. As should be appreciated, the outer wall section 520, groove 505, and lip 506 may be a formed as a unitary one-piece coupling 345.

Spaced inward from the outer wall section 520 is a cylinder 341. Extending radially outward from the cylinder 341 are one or more flexible connectors 615 (shown in FIG. 7). The flexible connectors 615 are configured to stretch and compress thereby allowing cylinder 341 and shaft 340 to oscillate while damping the oscillation. Typically, the flexible connectors 615 are a solid rubber or elastic material. In other embodiments, the flexible connectors 615 may be hollow. The outer wall section 520, cylinder 341 and flexible connectors 615 may be a formed as a unitary one-piece coupling 345.

A weight assembly extends through cylinder 341. The cylinder 341 surrounds and supports a shaft 340 having a first end 805 (shown in FIG. 9) located within the housing and a second end 810 extending outward from the housing 330. On the first end 805 of the shaft 340 is an inner weight 335 in a "floating" arrangement. The inner weight 335 is spaced inward from the housing 330 and does not touch the housing when it oscillates. On the second end 810, opposite the inner weight 335, the shaft 340 mounts to a threaded insert 355 and a cap or end damper 360 forming at least one weight. Optionally, one or more outer weights 350 may be circumferentially arranged on the second end 810. The outer weights 350 may be arranged in a sandwiched configuration between the coupling 345 and end dampener 360. The outer weights may serve as a fulcrum extending as a plate between shaft 340 and the forward end of coupling 345 when the weight assembly oscillates. The end damper 360 houses the insert 355. The end damper 360 may be formed of rubber and/or a similar flexible type material and assists in damping oscillations of the weight assembly.

Figure 6:
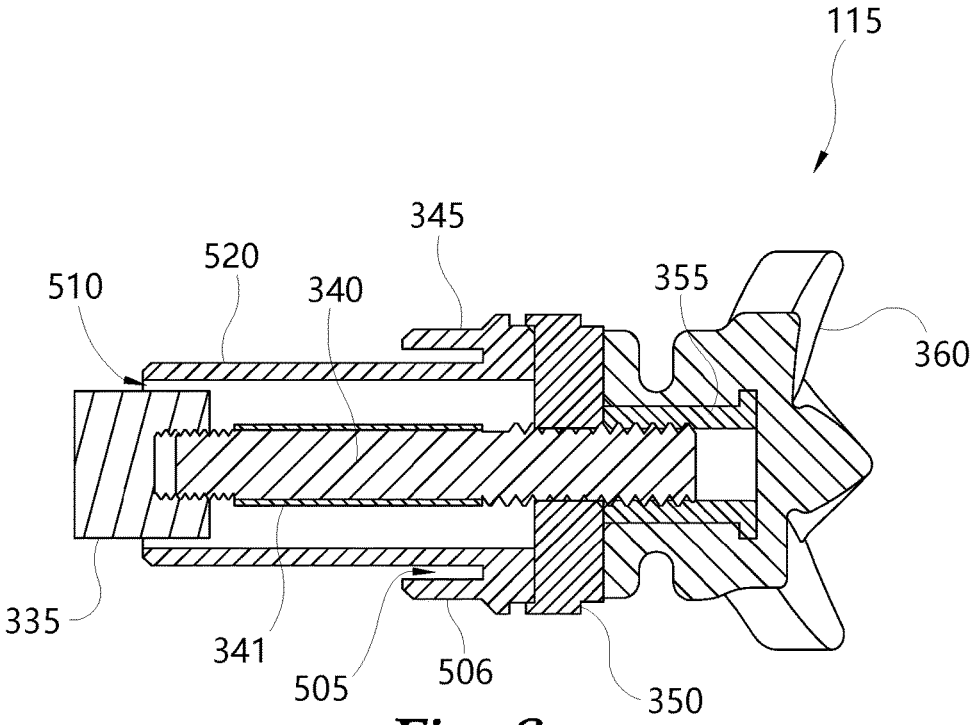
FIG. 6 is a cross-sectional view of a dampening assembly according to an embodiment of the present disclosure.

The cross-sectional views shown in FIGS. 5 and 6 illustrate the positioning and assembly of the damping assembly 115. The inner weight 335 is free from direct contact with the housing 330. The space between the inner weight 335 and the housing 330 defines one or more voids 510. The voids 510 are generally in the form of an air gap and allow the inner weight 335 to oscillate without directly contacting the housing 330. As should be appreciated, preventing direct contact between the inner weight 335 and the housing prevents the inner weight 335 and shaft 340 from transferring vibrations back into the housing 330. This "floating weight" design enables the stabilizer 100 to dissipate vibrations in the damping assembly 115 without transferring the vibrations back through the stabilizer and into the bow.

In one illustrative example, following a shot, vibration transfers through the bow limbs and into the riser. From the riser, vibrations transfer into the stabilizer and through the housing 330 into the damping assembly 115. The coupling 345 and the end damper 360 may absorb some of the vibration. The remaining vibration is transferred to the shaft 340 and the inner weight 335 causing them to start oscillate. The flexible connectors 615 allow the shaft 340 and inner weight 335 to oscillate within the housing 330 without contacting the housing 330. The flexible connectors 615 then work in connection with the shaft 340 and the inner weight 335 to dampen the oscillations, without transferring vibrations back into the bow.

Figure 7:
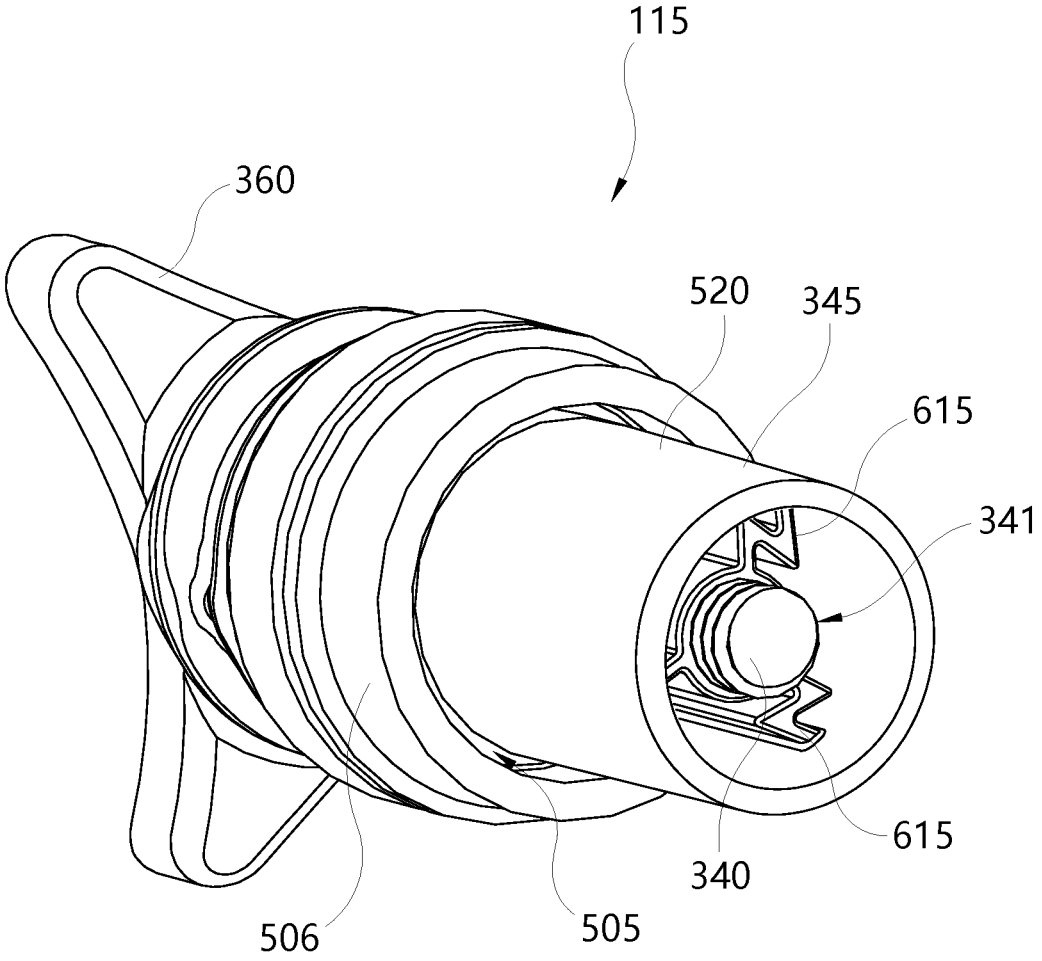
FIG. 7 is a perspective view of the dampening assembly of FIG. 6.
Figure 8A:
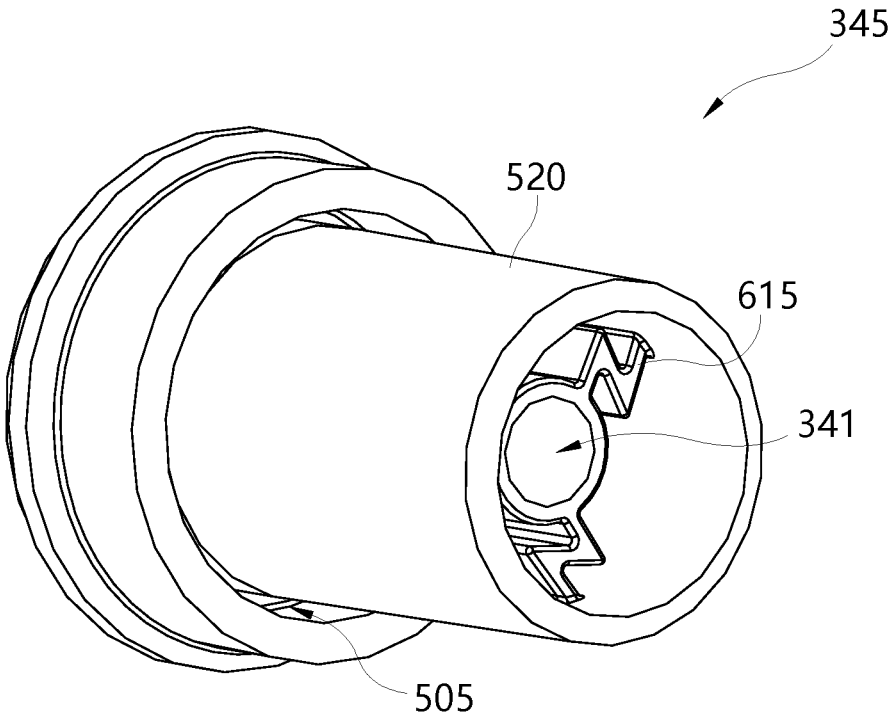
FIG. 8A is a perspective view of a coupling according to an embodiment of the present disclosure.
Figure 8B:
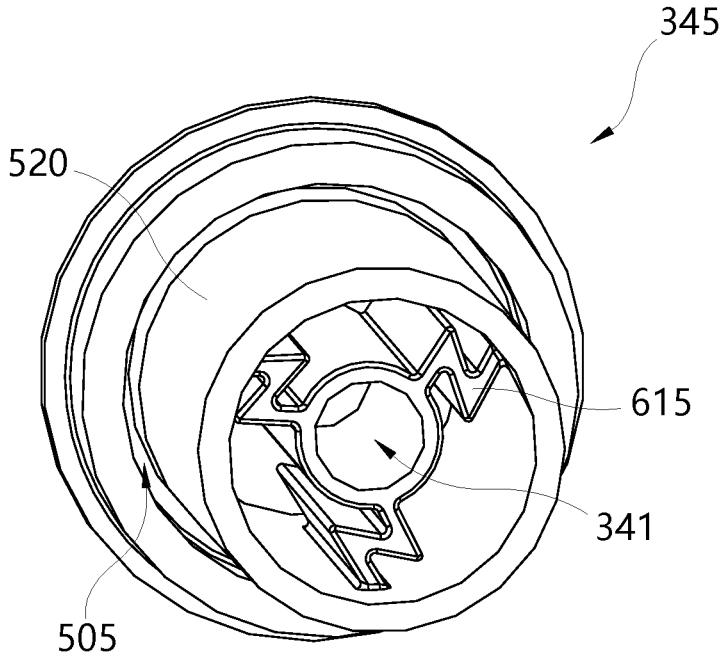
FIG. 8B is an alternate perspective view of the coupling of FIG. 8A.

FIGS. 7, 8A and 8B illustrate perspective views of the coupling 345. As can be seen, the flexible connectors 615 extend along at least a partial length of the inner surface of the outer wall section 520. However, in other examples, the flexible connectors 615 may extend for the entire length of the outer wall section 520. The illustrated coupling 345 includes three (3) flexible connectors spaced approximately 120 degrees apart. However, in other embodiments, the coupling 345 may include 2, 4, 5, 6, and/or more flexible connectors spaced between 10 and 180 degrees apart. The flexible connectors 615 may define a "Z" shape which stretches and compresses to enable oscillation of the inner weight 335 and the shaft 340. However, the flexible connectors in other embodiments may define other profiles and/or configurations.

Figure 9:
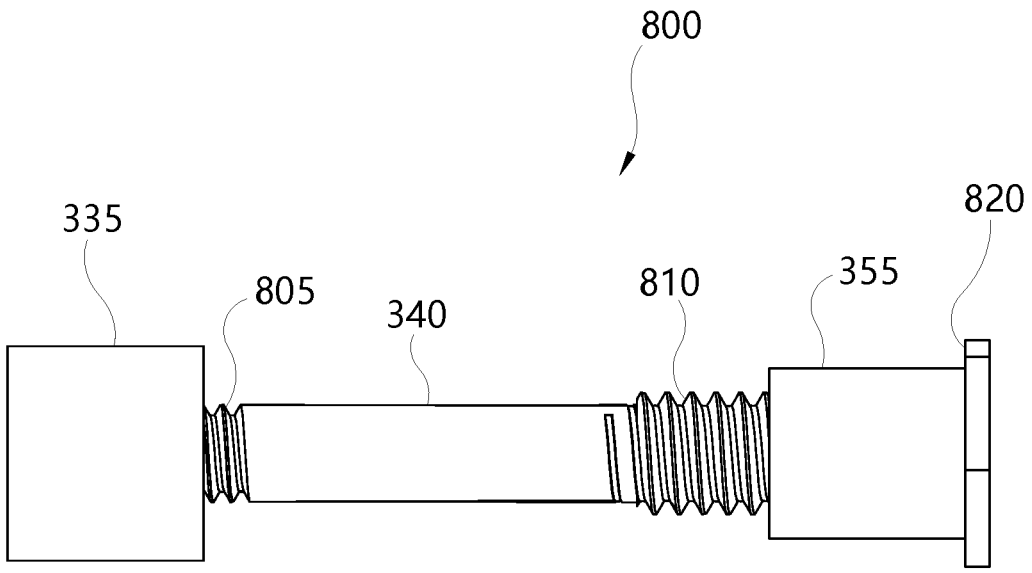
FIG. 9 is a side view of a weight assembly according to an embodiment of the present disclosure.

FIG. 9 illustrates a side view of a weight assembly 800. The weight assembly 800 includes the inner weight 335, the shaft 340, and the threaded insert 355. The weight assembly 800 may optionally include one or more outer weights 350, which are not shown in FIG. 9. The inner weight 335 is mounted to the shaft 340 on the first end 805, for example via a threaded engagement. The inner weight 335 may be removed from the shaft 340 and replaced with alternate weights to allow an archer to modify the weight of the stabilizer. For example, a heavier weight may be used with a bow generating more vibration, while a lighter weight may be used with a bow generating less vibration.

The threaded insert 355 is mounted to the shaft 340 on the second end 810. Insert 355 serves as an initial weight and to clamp any outer weights against the forward face of coupling 345. The threaded insert 355 may optionally include a lip 820 to assist in securing the insert 355 within the end damper 360. Typically, the shaft 340 is removable from the insert 355 to enable an archer to modify the stabilizer as desired. In some embodiments, the insert 355 is removable from the end damper 360. However, in other embodiments, the insert 355 is molded within the end damper 360 and is not removable.

Mounting assembly 110 is used to secure the stabilizer to an archery bow. The mounting assembly 110 includes an outsert 325, which is mounted to a proximal end 334 of the housing 330. The outsert 325 is secured to the housing 330 via a friction fit. In other examples, the outsert 325 is secure to the housing 330 via an adhesive material or a mechanical fastener. The outsert 325 is generally formed from a polymeric material, for example, plastic. However, in other examples, the outsert 325 may be formed from rubber or a similar flexible material.

The mounting assembly 110 (shown in FIG. 4) further includes a fastener 315 and a rod 320, which interact with mount housing 310. Fastener 315 is typically in the form of a threaded bolt and enables an archer to mount the stabilizer to the riser of an archery bow. Rod 320 is generally in the form of a threaded rod. In other embodiments, rod 320 is in the form of an unthreaded rod. Rod 320 interacts with a quick detach mechanism 305 and the outsert 325 to secure the body 105 to the mounting assembly 110. The quick detach mechanism 305 mates within a channel 405 (best shown in FIG. 5) of the mount housing 310 via a detent 307.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A stabilizer for an archery bow, comprising:

a hollow housing having a length defining a proximal end and a distal end, wherein the proximal end is configured to secure the housing to an archery bow;

a damping coupling formed of an elastic vibration damping material mounted to the distal end of the housing, the damping coupling including:

an outer wall section extending into the length of the housing from the distal end;

a cylinder spaced inward from the outer wall section; and, a plurality of flexible connectors extending radially from the cylinder to the outer wall section;

a shaft extending through the cylinder having a length defining a first end located within the housing and a second end extending outward from the housing;

an inner weight mounted to the first end of the shaft and spaced inward from the housing; and, at least one outer weight mounted to the second end of the shaft;

wherein the shaft and inner weight are arranged to oscillate within the damping coupling and housing without impacting the housing when vibrations are transferred to the stabilizer.

2. The stabilizer of claim 1, wherein the one or more flexible connectors define a Z shape.

3. The stabilizer of claim 1, wherein the second end of the shaft mounts to an insert housed within an end damper adjacent the distal end of the housing.

4. The stabilizer of claim 3, wherein the at least one outer weight is arranged between the coupling and the end damper in a sandwich configuration.

5. The stabilizer of claim 1, wherein the housing is made from carbon fiber.

6. The stabilizer of claim 1, wherein the coupling is made from rubber.

7. A stabilizer for an archery bow, comprising:

a hollow housing having a length defining a proximal end and a distal end, wherein the proximal end is configured to secure the housing to an archery bow;

a damping coupling formed of an elastic vibration damping material mounted to the distal end of the housing, the damping coupling including:

an outer wall section extending into the length of the housing from the distal end; and, a cylinder spaced inward from the outer wall section;

a shaft extending through the cylinder having a length defining a first end located within the housing and a second end extending outward from the housing;

an inner weight mounted to the first end of the shaft and spaced inward from the housing; and, wherein the shaft and inner weight are arranged to oscillate within the damping coupling and housing without impacting the housing when vibrations are transferred to the stabilizer.

8. The stabilizer of claim 7, wherein the housing is made from carbon fiber.

9. The stabilizer of claim 7, wherein the coupling is made from rubber.

10. The stabilizer of claim 7, further comprising:

a quick detach assembly, wherein the quick detach assembly includes a mount housing and a quick detach mechanism, and wherein the quick detach mechanism is configured to nest within the mount housing.

11. The stabilizer of claim 7, wherein the coupling further includes a plurality of flexible connectors extending radially from the cylinder to the outer wall section.

12. The stabilizer of claim 11, wherein the plurality of flexible connectors define a Z shape.

13. The stabilizer of claim 7, wherein the shaft and the inner weight are removable from the stabilizer.

14. The stabilizer of claim 7, wherein the second end of the shaft mounts to an insert housed within an end damper adjacent the distal end of the housing.

15. The stabilizer of claim 14, wherein the stabilizer includes at least one outer weight, and wherein the at least one outer weight is arranged between the coupling and the end damper in a sandwich configuration.

16. The stabilizer of claim 7, wherein the coupling includes a lip, wherein the outer wall section and the lip define a circumferential groove, and wherein the circumferential groove is configured to secure the coupling to the distal end of the housing via friction fit.

* * * * *